US009881544B2

(12) United States Patent
Qing et al.

(10) Patent No.: US 9,881,544 B2
(45) Date of Patent: Jan. 30, 2018

(54) PIXEL CIRCUIT FOR AC DRIVING, DRIVING METHOD AND DISPLAY APPARATUS

(71) Applicants: BOE TECHNOLOGY GROUP CO., LTD., Beijing (CN); CHENGDU BOE OPTOELECTRONICS TECHNOLOGY CO., LTD., Chengdu, Sichuan (CN)

(72) Inventors: Haigang Qing, Beijing (CN); Xiaojing Qi, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan Province (CN)

( * ) Notice: Subject to any disclaimer, the term of this patent is extended or adjusted under 35 U.S.C. 154(b) by 183 days.

(21) Appl. No.: 14/429,464

(22) PCT Filed: Jul. 29, 2014

(86) PCT No.: PCT/CN2014/083194
§ 371 (c)(1),
(2) Date: Mar. 19, 2015

(87) PCT Pub. No.: WO2015/062318
PCT Pub. Date: May 7, 2015

(65) Prior Publication Data

US 2016/0019836 A1 Jan. 21, 2016

(30) Foreign Application Priority Data

Oct. 31, 2013 (CN) ..... 2013 1 0530181

(51) Int. Cl.
*G09G 3/32* (2016.01)
*G09G 3/3233* (2016.01)
*G09G 3/3258* (2016.01)

(52) U.S. Cl.
CPC ..... *G09G 3/32* (2013.01); *G09G 3/3233* (2013.01); *G09G 3/3258* (2013.01);
(Continued)

(58) Field of Classification Search
None
See application file for complete search history.

(56) References Cited

U.S. PATENT DOCUMENTS

2004/0012336 A1* 1/2004 Okuda ..... G09G 3/3216 315/169.1
2005/0068274 A1* 3/2005 Lo ..... G09G 3/325 345/82

(Continued)

FOREIGN PATENT DOCUMENTS

CN 1622723 A 6/2005
CN 101373576 A 2/2009

(Continued)

OTHER PUBLICATIONS

International Search Report dated Oct. 27, 2014: PCT/CN2014/083194.

(Continued)

*Primary Examiner* — Amare Mengistu
*Assistant Examiner* — Sarvesh J Nadkarni
(74) *Attorney, Agent, or Firm* — Ladas & Parry LLP; Loren K. Thompson

(57) ABSTRACT

A pixel circuit for AC driving, a driving method and a display apparatus relate to display manufacturing field, and are capable of removing effect of internal resistance of a power supply line on a current for light-emitting and effect (Continued)

of a threshold voltage of a driving transistor on the display nonuniformity of a panel while effectively avoiding rapid aging of OLED. The pixel circuit includes: a first capacitor, a second capacitor, a first voltage input unit, a second voltage input unit, a data signal input unit, a first light emitting unit and a second light emitting unit.

16 Claims, 6 Drawing Sheets

(52) U.S. Cl.
CPC ..... *G09G 2300/0426* (2013.01); *G09G 2300/0804* (2013.01); *G09G 2300/0819* (2013.01); *G09G 2300/0852* (2013.01); *G09G 2300/0861* (2013.01); *G09G 2310/0256* (2013.01); *G09G 2320/043* (2013.01); *G09G 2320/045* (2013.01); *G09G 2330/028* (2013.01)

(56) References Cited

U.S. PATENT DOCUMENTS

2005/0110723 A1 5/2005 Shin
2005/0285827 A1 12/2005 Eom
2006/0125737 A1* 6/2006 Kwak ..... G09G 3/3233 345/76
2006/0169979 A1* 8/2006 Endo ..... G09G 3/3233 257/59
2006/0214596 A1* 9/2006 Miller ..... G09G 3/3233 315/169.3
2011/0050550 A1 3/2011 Tsai et al.
2012/0306374 A1* 12/2012 Lee ..... H05B 33/0896 315/121
2013/0314308 A1 11/2013 Hsu et al.
2015/0116191 A1* 4/2015 Qi ..... G09G 3/3233 345/76
2015/0287359 A1* 10/2015 Qing ..... G09G 3/3233 345/214
2015/0325169 A1* 11/2015 Qing ..... G09G 3/3225 345/214
2016/0253963 A1* 9/2016 Yang ..... G09G 3/3225 345/211

FOREIGN PATENT DOCUMENTS

CN 101833916 A 9/2010
CN 102779834 A 11/2012
CN 103000132 A 3/2013
CN 103366682 A 10/2013
CN 103531149 A 1/2014

OTHER PUBLICATIONS

Written Opinion of the International Searching Authority dated Oct. 27, 2014; PCT/CN2014/083194.

* cited by examiner

PIXEL CIRCUIT FOR AC DRIVING, DRIVING METHOD AND DISPLAY APPARATUS

TECHNICAL FIELD OF THE DISCLOSURE

The present disclosure relates to a pixel circuit for AC driving, a driving method and a display apparatus.

BACKGROUND

An AMOLED (Active Matrix Organic Light-Emitting Diode) is able to emit light as it is driven by a driving current generated by a driving TFT (Thin Film Transistor) in saturation. Different driving TFTs may have different critical voltages (i.e., threshold voltages) and may generate different driving currents when a same gray level voltage is input, thus rendering nonuniformity of the driving currents of the respective driving TFTs in the AMOLED. Under LTPS (Low Temperature Poly-silicon) manufacturing process, the threshold voltages Vth of TFTs have a poor uniformity and may have drifts as well, such that uniformity in luminance of AMOLED adopting the conventional 2T1C circuit is always poor. Another factor which has an effect on the uniformity in luminance of the AMOLED lies in that a power supply line which supplies power to OLED (Organic Light-Emitting Diode) has an internal resistance and OLED is a light emitting device driven by a current, a voltage drop is generated on the internal resistance of the power supply line when there is a current flowing through the OLED, thus directly rendering that power supply voltages at different locations cannot reach the required voltage.

In addition, aging problem of OLED is a common problem that all of the OLED light-emitting displays have to be faced with. DC driving is mostly adopted in the prior art, wherein the transmission directions of holes and electrons are fixed, the holes and electrons are injected to a light-emitting layer from a positive electrode and a negative electrode, respectively, and then excitons are formed in the light-emitting layer to radiate luminescent. Redundant holes (or electrons) which are not combined are accumulated at an interface between a hole transmission layer and the light-emitting layer (or an interface between the light-emitting layer and an electron transmission layer), or flow to the corresponding electrode across potential barrier. With prolong of the operation time, carriers not combined but accumulated at internal interfaces of the light-emitting layer allow that an built-in electric field is formed inside the OLED, which renders that the threshold voltage of the OLED increases continuously, the luminance of the OLED decreases continuously, and the energy utilization efficiency of the OLED decreases continuously. An AC driving circuit of OLED has been proposed in the prior art, which achieves AC driving for the OLED and solves the aging problem of the OLED, but cannot remove the effect of the internal resistance of the power supply line and the threshold voltage of the driving transistor on the display nonuniformity of the AMOLED.

SUMMARY

In order to solve the above technical problem, in embodiments of the present disclosure, there are provided a pixel circuit for AC driving, a driving method and a display apparatus capable of removing the effect of the internal resistance of the power supply line on the current for light-emitting and the effect of the threshold voltage of the driving transistor on the display nonuniformity of the AMOLED while effectively avoiding the rapid aging of the OLED.

In accordance with one aspect of the present disclosure, there is provided a pixel circuit for AC driving comprising: a first capacitor, a second capacitor, a first voltage input unit, a second voltage input unit, a data signal input unit, a first light emitting unit, and a second light emitting unit.

The first light emitting unit is configured to emit light under the control of a driving control terminal, a first voltage input terminal and a second voltage input terminal; and the second light emitting unit is configured to emit light under the control of the driving control terminal, the first voltage input terminal and the second voltage input terminal; wherein the first light emitting unit emits light during a preset first time period and the second light emitting unit emits light during a preset second time period.

The first voltage input unit is configured to supply a first input voltage at a first voltage terminal to the first light emitting unit and the second light emitting unit under the control of a first scan terminal; and the second voltage input unit is configured to supply a second input voltage at a second voltage terminal to the first light emitting unit and the second light emitting unit under the control of a second scan terminal.

The data signal input unit is configured to input a data line signal of a data line to the driving control terminal under the control of the first scan terminal.

A first electrode of the first capacitor is connected to the first voltage terminal and a second electrode of the first capacitor is connected to the first voltage input terminal; and a first electrode of the second capacitor is connected to the first voltage input terminal and a second electrode of the second capacitor is connected to the driving control terminal.

Optionally, the first voltage input unit comprises a first switching transistor having a gate connected to the first scan terminal, a source connected to the first voltage terminal, and a drain connected to the first voltage input terminal.

Optionally, the data signal input unit comprises a second switching transistor having a gate connected to the first scan terminal, a source connected to the data line, and a drain connected to the driving control terminal.

Optionally, the second voltage input unit comprises a third switching transistor having a gate connected to the second scan terminal, a source connected to the second voltage terminal, and a drain connected to the second voltage input terminal.

Optionally, the first light emitting unit comprises a first driving transistor and a first light emitting diode; the first driving transistor has a gate connected to the driving control terminal and a source connected to the first voltage input terminal; and the first light emitting diode has a first electrode connected to a drain of the first driving transistor and a second electrode connected to the second voltage input terminal.

The second light emitting unit comprises a second driving transistor and a second light emitting diode; the second driving transistor has a gate connected to the driving control terminal and a source connected to the first voltage input terminal; and the second light emitting diode has a first electrode connected to the second voltage input terminal and a second electrode connected to a drain of the second driving transistor.

The first driving transistor and the second driving transistor are of different types.

Optionally, the first light emitting unit emits light during a preset high level period or a preset low level period supplied between the first voltage terminal and the second voltage terminal, and the second light emitting unit emits light during a preset low level period or a preset high level period supplied between the first voltage terminal and the second voltage terminal.

In accordance with another aspect of the present disclosure, there is provided a display apparatus comprising any one of the above described pixel circuits.

In accordance with another aspect of the present disclosure, there is provided a driving method for the above described pixel circuit comprising: during a first stage, controlling the first voltage input unit to close and the data signal input unit to operate by aid of the first scan terminal such that a first reference voltage is input to the driving control terminal from the data line, and controlling the second voltage input unit to operate by aid of the second scan terminal such that the second voltage input terminal and the second voltage terminal are connected to each other, the first capacitor and the second capacitor are charged to reset a voltage at the first voltage input terminal; during a second stage, controlling the first voltage input unit to close and the data signal input unit to operate by aid of the first scan terminal such that a data voltage is input to the driving control terminal from the data line, and controlling the second voltage input unit to close by aid of the second scan terminal such that the voltage at the first voltage input terminal transits due to coupling effect of the second capacitor; during a third stage, controlling the first voltage input unit to operate and the data signal input unit to close by aid of the first scan terminal, and controlling the second voltage input unit to operate by aid of the second scan terminal such that the first light emitting unit is driven to emit light by aid of the driving control terminal, the first voltage input terminal and the second voltage input terminal; during a fourth stage, controlling the first voltage input unit to close and the data signal input unit to operate by aid of the first scan terminal such that a second reference voltage is input to the driving control terminal from the data line, and controlling the second voltage input unit to operate by aid of the second scan terminal such that the second voltage input terminal and the second voltage terminal are connected to each other, the first capacitor and the second capacitor are charged to reset the voltage at the first voltage input terminal; during a fifth stage, controlling the first voltage input unit to close and the data signal input unit to operate by aid of the first scan terminal such that a data voltage is input to the driving control terminal from the data line, and controlling the second voltage input unit to close by aid of the second scan terminal such that the voltage at the first voltage input terminal transits due to coupling effect of the second capacitor; and during a sixth stage, controlling the first voltage input unit to operate and the data signal input unit to close by aid of the first scan terminal, and controlling the second voltage input unit to operate by aid of the second scan terminal such that the second light emitting unit is driven to emit light by aid of the driving control terminal, the first voltage input terminal and the second voltage input terminal.

Optionally, during the first stage, the first switching transistor and the second driving transistor are turned off, and the second switching transistor, the third switching transistor and the first driving transistor are turned on; during the second stage, the first switching transistor and the third switching transistor are turned off, the second switching transistor is turned on, and the first driving transistor and the second driving transistor are in an open-circuit state; during the third stage, the first switching transistor, the third switching transistor and the first driving transistor are turned on, and the second switching transistor and the second driving transistor are turned off; during the fourth stage, the first switching transistor and the first driving transistor are turned off, and the second switching transistor, the third switching transistor and the second driving transistor are turned on; during the fifth stage, the first switching transistor and the third switching transistor are turned off, the second switching transistor is turned on, and the first driving transistor and the second driving transistor are in an open-circuit state; and during the sixth stage, the first switching transistor, the third switching transistor and the second driving transistor are turned on, and the second switching transistor and the first driving transistor are turned off.

In the pixel circuit for AC driving, the driving method and the display apparatus proposed in the embodiments of the present disclosure, AC driving of the pixel circuit can be achieved by arranging compensation capacitors and two light emitting units which operate during different time periods respectively in each pixel circuit, thus capable of removing the effect of the internal resistance of the power supply line on the current for light emitting and the effect of the threshold voltage of the driving transistor on the display nonuniformity of the AMOLED while avoiding the rapid aging of the OLED effectively.

BRIEF DESCRIPTION OF THE DRAWINGS

In order to more clearly describe the technical solutions of the embodiments of the present disclosure or the prior art, drawings necessary for describing the embodiments of the present disclosure or the prior art are simply introduced as follows. It should be obvious for those skilled in the art that the drawings described as follows are only some embodiments of the present disclosure.

DETAILED DESCRIPTION

Hereinafter, the technical solutions in the embodiments of the present disclosure will be described clearly and thoroughly with reference to the accompanying drawings of the embodiments of the present disclosure. Obviously, the embodiments as described are only some of the embodiments of the present disclosure, and are not all of the embodiments of the present disclosure.

Switching transistors and driving transistors adopted in the embodiments of the present disclosure may be Thin Film Transistors or Field Effect Transistors or other devices having the same characteristics. In addition, the transistors adopted in the embodiments of the present disclosure may comprise P type transistors and N type transistors, wherein each of the P type transistors is turned on when its gate is at a low level and turned off when its gate is at a high level, and each of the N type transistors is turned on when its gate is at a high level and turned off when its gate is at a low level. The term of "turn on" can also be replaced by "switch on" or "operate" in the technical field to represent a corresponding function in the embodiments of the present disclosure, and the term of "turn off" can also be replace by "switch off" or "close" in the technical field to represent a corresponding function in the embodiments of the present disclosure.

Figure 1:
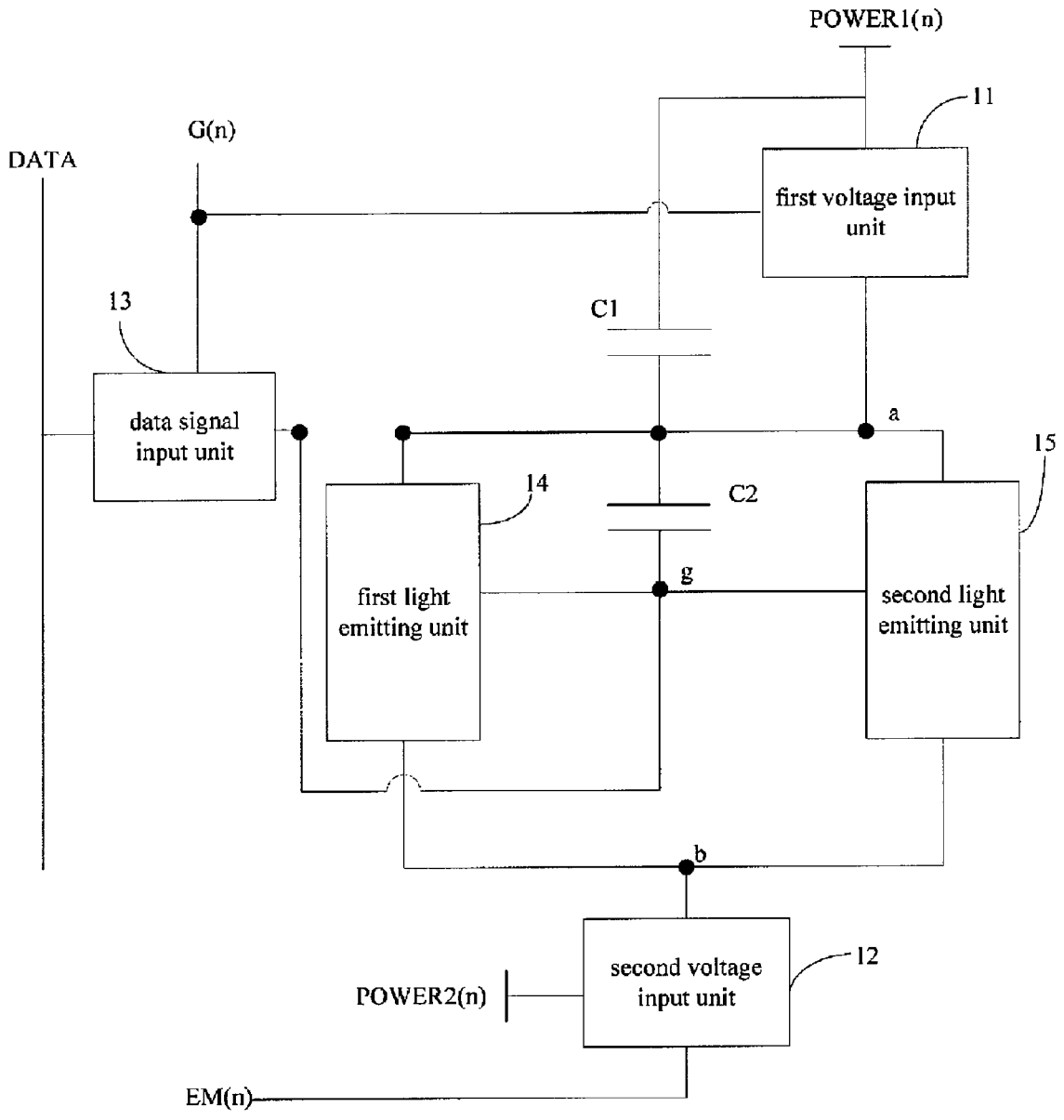
FIG. 1 is a schematic structure diagram of a pixel circuit for AC driving provided in embodiments of the present disclosure.

With reference to FIG. 1, a pixel circuit for AC driving in accordance with embodiments of the present disclosure comprises: a first capacitor C1, a second capacitor C2, a first voltage input unit 11, a second voltage input unit 12, a data signal input unit 13, a first light emitting unit 14, and a second light emitting unit 15.

The first light emitting unit 14 is connected to a first voltage input terminal a, a second voltage input terminal b and a driving control terminal g, and is configured to emit light during a $N^{th}$ frame under the control of the driving control terminal g, the first voltage input terminal a and the second voltage input terminal b.

The second light emitting unit 15 is connected to the first voltage input terminal a, the second voltage input terminal b and the driving control terminal g, and is configured to emit light during a $(N+1)^{th}$ frame adjacent to the $N^{th}$ frame under the control of the driving control terminal g, the first voltage input terminal a and the second voltage input terminal b.

The first voltage input unit 11 is connected to a first voltage terminal POWER1(*n*), the first voltage input terminal a and a first scan terminal G(n); and is configured to supply a first input voltage at the first voltage terminal POWER1(*n*) to the first light emitting unit 14 and the second light emitting unit 15 under the control of the first scan terminal G(n).

The second voltage input unit 12 is connected to a second voltage terminal POWER2(*n*), the second voltage input terminal b and a second scan terminal EM(n); and is configured to supply a second input voltage at the second voltage terminal POWER2(*n*) to the first light emitting unit 14 and the second light emitting unit 15 under the control of the second scan terminal EM(n).

The data signal input unit 13 is connected to a data line DATA, the first scan terminal G(n) and the driving control terminal g; and is configured to input a data line signal of the data line DATA to the driving control terminal g under the control of the first scan terminal G(n).

A first electrode of the first capacitor C1 is connected to the first voltage terminal POWER1(*n*), and a second electrode of the first capacitor C1 is connected to the first voltage input terminal a.

A first electrode of the second capacitor C2 is connected to the first voltage input terminal a, and a second electrode of the second capacitor C2 is connected to the driving control terminal g.

The first time period and the second time period can be two adjacent data frames but not limited thereto. The first time period and the second time period can be set according to requirement. Commonly, "a data frame (simply referred to as a frame)" is the time of "a display period" and is about several to tens milliseconds.

In the pixel circuit for AC driving provided in the embodiments of the present disclosure, the AC driving of the pixel circuit can be achieved by arranging compensation capacitors and two light emitting units which operate during different time periods respectively in the pixel circuit, thus removing the effect of the internal resistance of the power supply line on the current for light-emitting and the effect of the threshold voltage of the driving transistor on the display nonuniformity of the AMOLED while effectively avoiding the rapid aging of the OLED.

In accordance with the embodiments of the present disclosure, the first voltage input unit 11 may comprise a first switching transistor T1 having a gate connected to the first scan terminal G(n), a source connected to the first voltage terminal POWER1(*n*), and a drain connected to the first voltage input terminal a.

The data signal input unit 13 may comprise a second switching transistor T2 having a gate connected to the first scan terminal G(n), a source connected to the data line DATA, and a drain connected to the driving control terminal g.

The second voltage input unit 12 may comprise a third switching transistor T3 having a gate connected to the second scan terminal EM(n), a source connected to the second voltage terminal POWER2(*n*), and a drain connected to the second voltage input terminal b.

The first light emitting unit 14 may comprise a first driving transistor DTFT1 and a first light emitting diode OLED1. The first driving transistor DTFT1 has a gate connected to the driving control terminal g and a source connected to the first voltage input terminal a. The first light emitting diode OLED1 has a first electrode connected to a drain of the first driving transistor DTFT1 and a second electrode connected to the second voltage input terminal b.

The second light emitting unit 15 may comprise a second driving transistor DTFT2 and a second light emitting diode OLED2. The second driving transistor DTFT2 has a gate connected to the driving control terminal g and a source connected to the first voltage input terminal a. The second light emitting diode OLED2 has a first electrode connected to the second voltage input terminal b and a second electrode connected to a drain of the second driving transistor DTFT2.

During the first time period (for example, the $N^{th}$ frame), the second light emitting diode OLED2 in the second light emitting unit 15 is reverse biased and is in a recovery phase; during the second time period (for example, the $(N+1)^{th}$ frame), the first light emitting diode OLED1 in the first light emitting unit 14 is reverse biased and is in a recovery phase.

The first driving transistor DTFT1 and the second driving transistor DTFT2 are of different types. For example, the first driving transistor DTFT1 is a P type transistor and the second driving transistor DTFT2 is a N type transistor.

The first light emitting unit 14 emits light during a preset high level period or a preset low level period supplied between the first voltage terminal POWER1(*n*) and the second voltage terminal POWER2(*n*), and the second light emitting unit 15 emits light during a preset low level period or a preset high level period supplied between the first voltage terminal POWER1(*n*) and the second voltage terminal POWER2(*n*).

Optionally, when alternating current is supplied, the first light emitting unit 14 emits light during a positive half cycle or a negative half cycle of the alternating current supplied between the first voltage terminal POWER1(*n*) and the second voltage terminal POWER2(*n*), and the second light emitting unit 15 emits light during a negative half cycle or a positive half cycle of the alternating current supplied between the first voltage terminal POWER1(*n*) and the second voltage terminal POWER2(*n*). That is, the first light emitting unit emits light during a positive half cycle of the alternating current when the second light emitting unit emits light during a negative half cycle of the alternating current. Alternatively, the first light emitting unit emits light during a negative half cycle of the alternating current when the second light emitting unit emits light during a positive half cycle of the alternating current. Particularly, the alternating current can be supplied in the following manner: the voltage between the first voltage terminal POWER1(*n*) and the second voltage terminal POWER2(*n*) transits to its reverse voltage, when the current pixel circuit changes its output from the current frame to a next frame.

In accordance with the embodiments of the present disclosure, there is provided a display apparatus comprising the above described pixel circuit.

In the display apparatus provided in the embodiments of the present disclosure, the AC driving of the pixel circuit can be achieved by arranging compensation capacitors and two light emitting units which operate during different time periods respectively in the pixel circuit, thus removing the effect of the internal resistance of the power supply line on the current for light emitting and the effect of the threshold voltage of the driving transistor on the display nonuniformity of the AMOLED while effectively avoiding the rapid aging of the OLED.

In accordance with the embodiments of the present disclosure, there is further provided a driving method of pixel circuit which comprises six stages.

During a first stage, the first voltage input unit is controlled to close and the data signal input unit is controlled to operate by aid of the first scan terminal such that a first reference voltage is input to the driving control terminal from the data line, and the second voltage input unit is controlled to operate by aid of the second scan terminal such that the second voltage input terminal and the second voltage terminal are connected to each other, the first capacitor and the second capacitor are charged to reset a voltage at the first voltage input terminal. For example, the first capacitor and the second capacitor are charged in a first direction during the first stage.

During a second stage, the first voltage input unit is controlled to close and the data signal input unit is controlled to operate by aid of the first scan terminal such that a data voltage is input to the driving control terminal from the data line, and the second voltage input unit is controlled to close by aid of the second scan terminal such that the voltage at the first voltage input terminal transits due to coupling effect of the second capacitor.

During a third stage, the first voltage input unit is controlled to operate and the data signal input unit is controlled to close by aid of the first scan terminal, and the second voltage input unit is controlled to operate by aid of the second scan terminal such that the first light emitting unit is driven to emit light by aid of the driving control terminal, the first voltage input terminal and the second voltage input terminal.

During a fourth stage, the first voltage input unit is controlled to close and the data signal input unit is controlled to operate by aid of the first scan terminal such that a second reference voltage is input to the driving control terminal from the data line, and the second voltage input unit is controlled to operate by aid of the second scan terminal such that the second voltage input terminal and the second voltage terminal are connected to each other, the first capacitor and the second capacitor are charged to reset the voltage at the first voltage input terminal. For example, the first capacitor and the second capacitor are charged in a second direction opposite to the first direction in the fourth stage.

During a fifth stage, the first voltage input unit is controlled to close and the data signal input unit is controlled to operate by aid of the first scan terminal such that a data voltage is input to the driving control terminal from the data line, and the second voltage input unit is controlled to close by aid of the second scan terminal such that the voltage at the first voltage input terminal transits due to coupling effect of the second capacitor.

During a sixth stage, the first voltage input unit is controlled to operate and the data signal input unit is controlled to close by aid of the first scan terminal, and the second voltage input unit is controlled to operate by aid of the second scan terminal such that the second light emitting unit is driven to emit light by aid of the driving control terminal, the first voltage input terminal and the second voltage input terminal.

In accordance with the embodiments of the present disclosure, optionally, during the first stage, the first switching transistor and the second driving transistor are turned off, and the second switching transistor, the third switching transistor and the first driving transistor are turned on; during the second stage, the first switching transistor and the third switching transistor are turned off, the second switching transistor is turned on, and the first driving transistor and the second driving transistor are in an open-circuit state; during the third stage, the first switching transistor, the third switching transistor and the first driving transistor are turned on, and the second switching transistor and the second driving transistor are turned off; during the fourth stage, the first switching transistor and the first driving transistor are turned off, and the second switching transistor, the third switching transistor and the second driving transistor are turned on; during the fifth stage, the first switching transistor and the third switching transistor are turned off, the second switching transistor is turned on, and the first driving transistor and the second driving transistor are in an open-circuit state; and during the sixth stage, the first switching transistor, the third switching transistor and the second driving transistor are turned on, and the second switching transistor and the first driving transistor are turned off.

In the driving method for the pixel circuit for AC driving provided in the embodiments of the present disclosure, the AC driving of the pixel circuit can be achieved by arranging compensation capacitors and two light emitting units which operate during different time periods respectively in the pixel circuit, thus removing the effect of the internal resistance of the power supply line on the current for light-emitting and the effect of the threshold voltage of the driving transistor on the display nonuniformity of the AMOLED while effectively avoiding the rapid aging of the OLED.

The above first scan terminal and the above second scan terminal can be supplied power in a separate manner, or can be supplied power in a manner of scan lines, or can be supplied power in any combination manner of the above two manners. The following specific embodiments will be described in the manner of scan lines, that is, the first scan line functions as the first scan terminal and the second scan line functions as the second scan terminal, so as to supply and input control signals to the circuit in accordance with the embodiments of the present disclosure.

Figure 2:
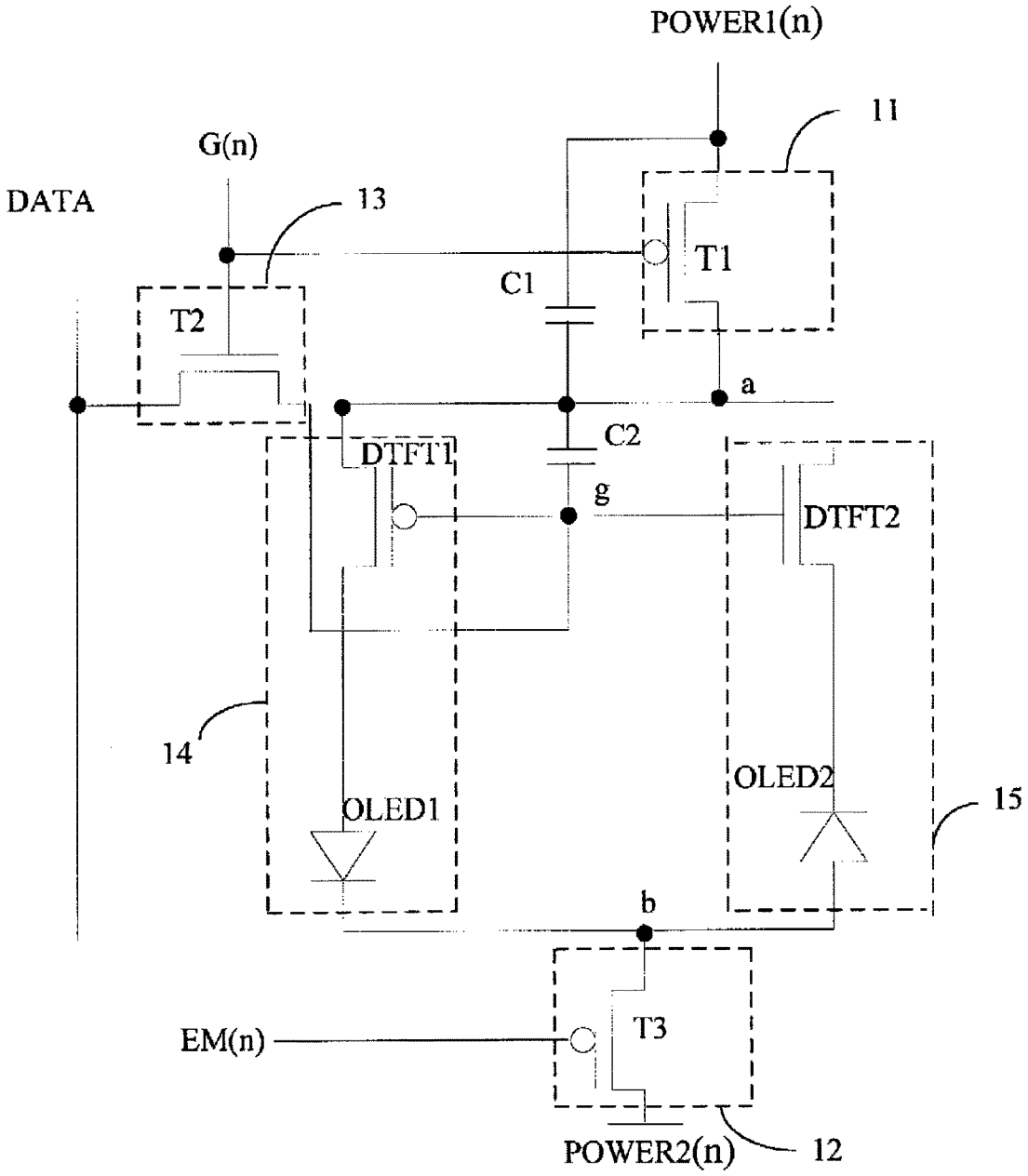
FIG. 2 is another schematic structure diagram of a pixel circuit for AC driving provided in the embodiments of the present disclosure.
Figure 3:
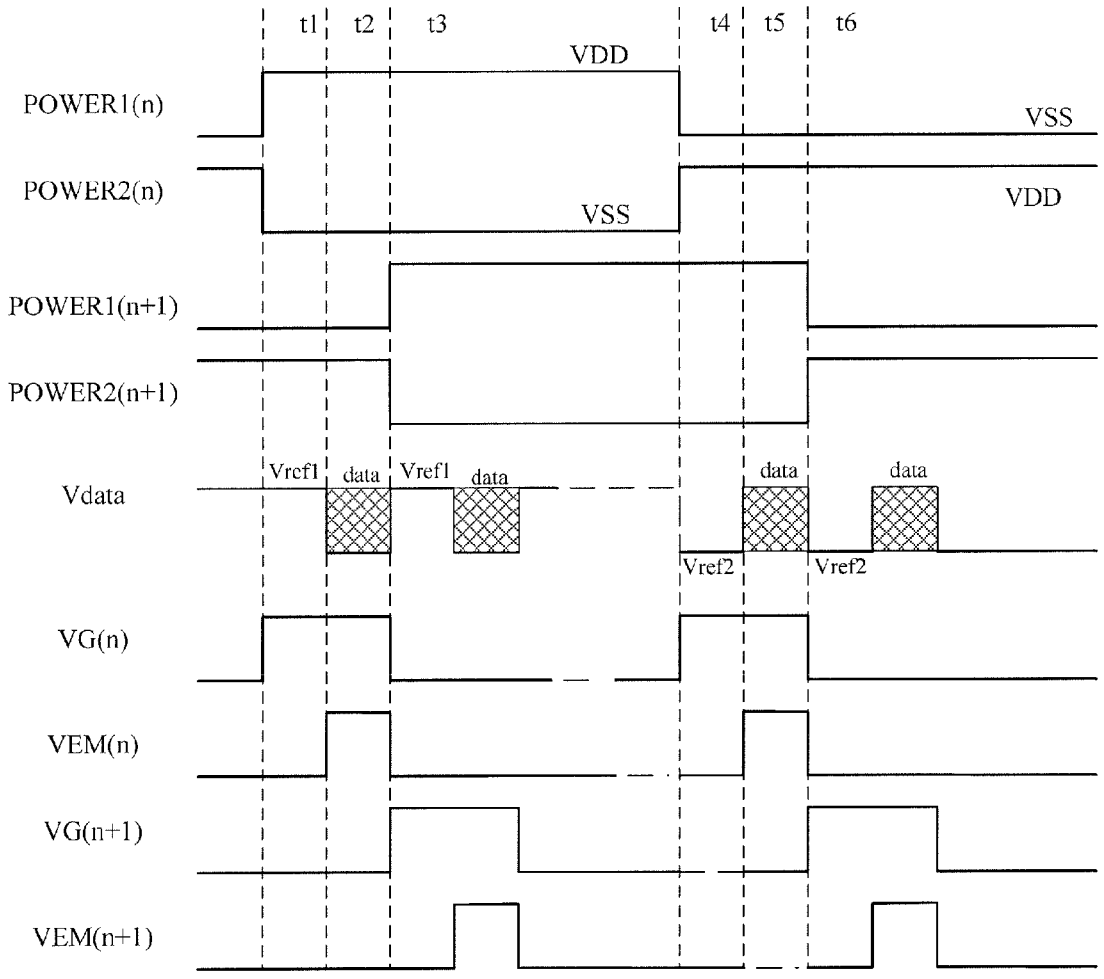
FIG. 3 is a schematic diagram of timing sequence states of input signals of the pixel circuit for AC driving provided in the embodiments of the present disclosure.

Particularly, the driving method for the pixel circuit provided in the embodiments of the present disclosure will be described in detail by combining the timing sequence state diagram as shown in FIG. 3 and the pixel circuit as shown in FIG. 2 and taking the case that the first time period and the second time period are two adjacent data frames ($N^{th}$ and $(N+1)^{th}$) as an example.

FIG. 2 is a principal diagram of a pixel driving circuit in accordance with the embodiments of the present disclosure. The structure of the circuit as a whole comprises three switching transistors (T1-T3), two driving transistors DTFT1 and DTFT2, two capacitors C1 and C2, and two light emitting diodes OLED1 and OLED2, wherein DTFT1 is of P type, DTFT2 is of N type, T1 and T3 are P type switching transistors and T2 is a N type switching transistor. It should be understood that a light emitting diode comprises a cathode and an anode and thus a first electrode and a second electrode of each of the above light emitting diodes are a cathode and an anode of the light emitting diode, respectively, and are connected to the drain of the driving transistor according to specific requirement. In the present embodiment, the first electrode of the light emitting diode is the anode and the second electrode of the light emitting diode is the cathode. For each row, the pixel circuits in this row share a first scan signal line G(n) and a second scan signal line EM(n) for controlling light-emitting, two power supply signals supplied from a first voltage terminal POWER1(*n*) and a second voltage terminal POWER2(*n*) respectively, and a data line DATA.

It should be noted that the pixel circuits in a same row should be controlled by individual power supply signals, and the power supply signals (the first voltage terminal POWER1 and the second voltage terminal POWER2) for the pixel circuits in the same row should flip over every frame time period.

With reference to FIG. 3, power supplies for the current pixel circuit are supplied from the first voltage terminal POWER1(*n*) and the second voltage terminal POWER2(*n*), and power supplies for the pixel circuit of a next stage are supplied from the first voltage terminal POWER1(*n*+1) and the second voltage terminal POWER2(*n*+1).

FIG. 3 further shows the first scan line signal G(n) and the second scan line signal EM(n) for the current pixel circuit and the first scan line signal G(n+1) and the second scan line signal EM(n+1) for the pixel circuit of the next stage. The operation of the pixel circuits in a same row is divided into three stages for each frame, as shown in FIG. 3, the operation of the pixel circuits in the same row comprises three stages t1-t3 for the current frame and three stages t4-t6 for the next frame. Since the light-emitting driving for two adjacent frames are performed alternately by symmetric portions in the pixel circuit, the operation of the circuit in each of total six stages for the two adjacent frames will be described one by one, but the operation of the circuit itself only needs three stages.

The ON level of the N-type switching transistor is a high level VGH and the OFF level of the N-type switching transistor is a low level VGL. The ON level of the P-type switching transistor is a low level VGL and the OFF level of the P-type switching transistor is a high level VGL. A high level of the power supplies is VDD and a low level of the power supplies is VSS. Relative to P-type switching transistors, when N-type switching transistors are adopted, the timing sequence of the signal at the gate should be adjusted only if the switching transistors in the embodiments of the present disclosure can achieve the switching function in the method claims.

The specific timing sequence diagram of the circuit is as shown in FIG. 3 and the operation in the three stages of the $N^{th}$ frame is as follows.

Figure 4:
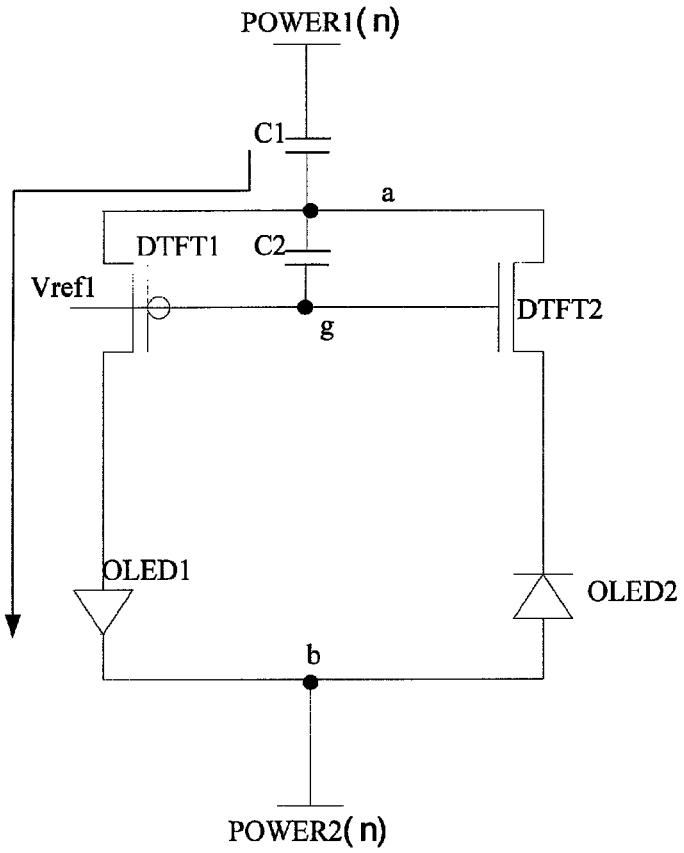
FIG. 4 is an equivalent circuit diagram of the pixel circuit for AC driving operating in a first stage provided in the embodiments of the present disclosure.

During a first stage t1, the equivalent circuit is as shown in FIG. 4, G(n) is at a high level, and EM(n) is at a low level. T1 is turned off, T2 and T3 are turned on, meanwhile POWER2(*n*) transits from VDD to VSS and POWER1(*n*) transits from VSS to VDD. At this time, signal at the data line DATA is a first reference voltage Vref1. It should be explained that the first reference voltage Vref1 corresponds to a minimum gray level data signal voltage, that is, for the P type driving transistor DTFT1, Vref1 can be selected as Vdata(max) (i.e., maximum value of the data line signal), and thus Vref1 satisfies the following conditions:

$$VDD-V\text{ref}1>|Vthd1| \text{ and } V\text{ref}1>=V\text{data},$$

wherein Vthd1 is a threshold voltage of the DTFT1, Vdata (max) is a maximum value of voltage of the data line signal. At this time, since OLED2 enters into the negative half cycle of the AC driving from the positive half cycle of the AC driving and thus is reverse biased when POWER1(*n*) and POWER2(*n*) start the voltage transitions, there is no current flowing through the OLED2 and the source of the DTFT2 is in an open-circuit state although the DTFT2 is turned on, and OLED2 enters into a recovery period. The first capacitor C1 and the second capacitor C2 are charged through the DTFT1 in a direction from POWER1(*n*) to POWER2(*n*) since the DTFT1 is turned on by Vref1, a current flows through the OLED1, and the potential at the point a is reduced continuously until the potential at the point a is Vref1+|Vthd1|, therefore the potential at the point a is: Va=Vref1+|Vthd1|.

Figure 5:
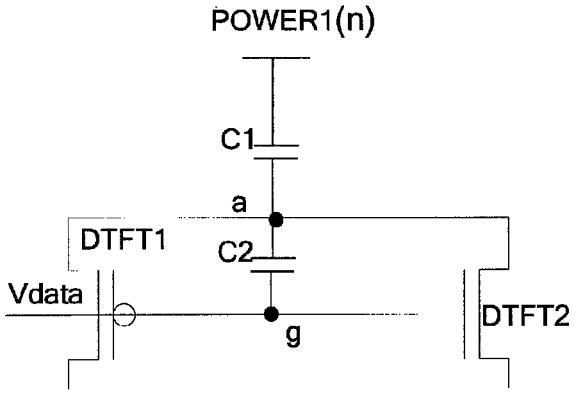
FIG. 5 is an equivalent circuit diagram of the pixel circuit for AC driving operating in a second stage provided in the embodiments of the present disclosure.

During a second stage t2, the equivalent circuit is as shown in FIG. 5, G(n) is at a high level, and EM(n) transits to a high level, T1 and T3 are turned off, and T2 is turned on. The point a is in a floating state and the voltage at the data line transits from Vref1 to Vdata, therefore the potential at the point a transits as follows due to the coupling effect of C2:

$$Va=V\text{ref}1+|Vthd1|+(V\text{data}-V\text{ref}1)*C2/(C1+C2).$$

Therefore, the voltage across two electrodes of C2 can be represented by:

$$\begin{aligned} Vc2 &= Va - Vg \\ &= Vref1 + |Vthd1| + (Vdata - Vref1) * C2/(C1 + C2) - Vdata \\ &= (Vref1 - Vdata) * C1/(C1 + C2) + |Vthd1|. \end{aligned}$$

In this stage, OLED1 and OLED2 are both in an open-circuit state.

Figure 6:
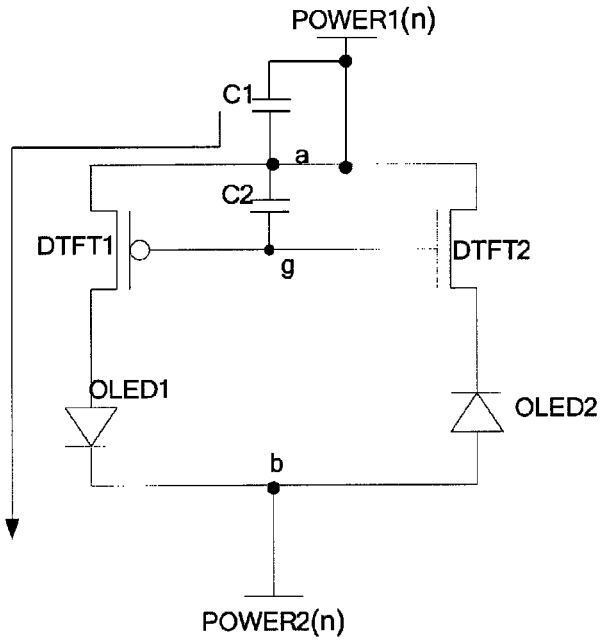
FIG. 6 is an equivalent circuit diagram of the pixel circuit for AC driving operating in a third stage provided in the embodiments of the present disclosure.

During a third stage t3, the equivalent circuit is as shown in FIG. 6, G(n) transits to a low level, EM(n) transits to a low level, such that T1 and T3 are turned on and T2 is turned off. At this time, OLED1 is forward biased and is in the positive half cycle of the AC driving such that OLED1 enters into the operation state, while OLED2 is reverse biased and is in the negative half cycle of the AC driving such that OLED2 enters into a recovery period and no current flows through OLED2. Therefore, the source of the DTFT2 is in an open-circuit state. In this third stage, the first capacitor C1 is short-circuited since T1 is turned on, and the potential at the point a maintains at VDD of the POWER1(*n*).

The gate of the DTFT1 is in a floating state since T2 is turned off, and thus variation of the potential at the point a has no effect on the voltage across the two electrodes of the capacitor C2, and the gate-source voltage of the DTFT1 maintains the voltage across the two electrodes of C2 during its previous stage, that is, $$Vsg=Vc2=(Vref1-Vdata)*C1/(C1+C2)+|Vthd1|.$$

The driving current flowing through the DTFT1 is the light-emitting current of the OLED1 and can be represented by:

$$\begin{aligned} Ioled1 &= kd1(Vsg-|Vthd1|)\hat{}2 \\ &= kd1[(Vref1-Vdata)*C1/(C1+C2)+|Vthd1|-|Vthd1|]\hat{}2 \\ &= kd1[(Vref1-Vdata)*C1/(C1+C2)]\hat{}2; \end{aligned}$$

Kd1 is a constant relating to the manufacturing process and the size configuration of the driving transistor DTFT1, and Vthd1 is the threshold voltage of the DTFT1. The driving current is only affected by the data voltage Vdata and the first reference voltage Vref1, but is not relevant to the threshold voltage of the driving transistor DTFT1.

During the first stage, OLED2 enters into the negative half cycle of the AC driving from the positive half cycle of the AC driving and will stay in the negative half cycle of the AC driving during the time period of a frame. During the negative half cycle of the AC driving, the remaining holes and electrons at the interfaces of the light emitting layer of OLED2 change their moving directions to move toward opposite directions, which is equivalent to consuming the remaining holes and electrons, thus diminishing the built-in electrical field formed inside OLED2 by the remaining carriers in the positive half cycle, further enhancing the carrier injection and recombination in the next positive half cycle, and finally improving the recombination efficiency. Moreover, the reverse bias process in the negative half cycle can "burn out" some microscopic small channels "filaments" turned on locally. Such a filament is actually caused by a kind of "pinhole" which is a fine hole formed due to non-uniform deposition during the semiconductor deposition process, and the elimination of the pinholes is very important for extending the usage life of the device. Therefore, in other words, OLED2 is in a recovery period during the time period of this frame.

After the time period of one frame, a $(N+1)^{th}$ frame comes, the operation of the circuit in the three stages for this frame is as follows.

Figure 7:
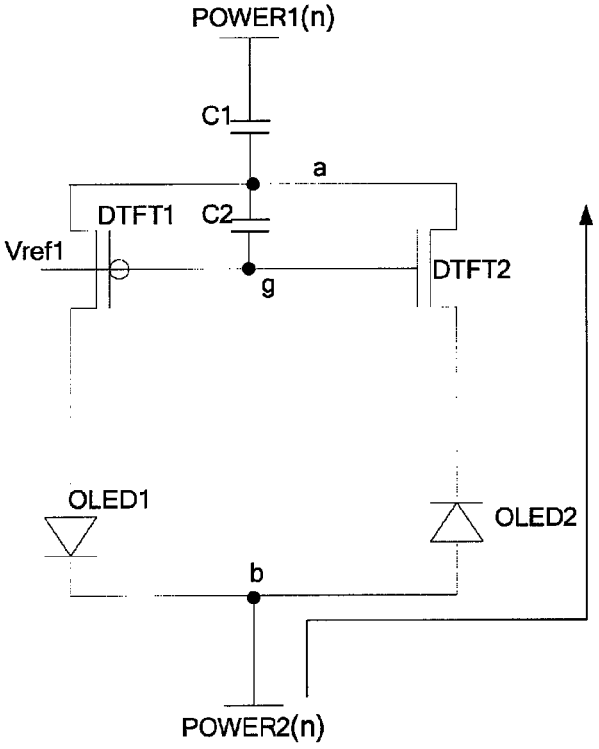
FIG. 7 is an equivalent circuit diagram of the pixel circuit for AC driving operating in a fourth stage provided in the embodiment of the present disclosure.

During a fourth stage t4, the equivalent circuit is as shown in FIG. 7, G(n) is at a high level, and EM(n) is at a low level. T1 is turned off, T2 and T3 are turned on, meanwhile POWER1(*n*) transits from VDD to VSS and POWER2(*n*) transits from VSS to VDD.

At this time, signal at the data line DATA is a second reference voltage Vref2. It should be explained that the second reference voltage Vref2 corresponds to a minimum gray level data signal voltage, that is, for the N type driving transistor DTFT2, Vref2 can be selected as Vdata(min), and thus Vref2 satisfies the following conditions:

$$Vref2-VSS>Vthd2 \text{ and } Vref2<=Vdata,$$

wherein Vthd2 is a threshold voltage of the DTFT2, Vdata (min) is a minimum value of voltage of the data line signal. At this time, since OLED1 enters into the negative half cycle of the AC driving from the positive half cycle of the AC driving and thus is reverse biased when POWER1(*n*) and POWER2(*n*) start the voltage transitions, there is no current flowing through the OLED1 and the source of the DTFT1 is in an open-circuit state although the DTFT1 is turned on, and OLED1 enters into a recovery period. Since the voltage across the two electrodes of the first capacitor C1 is 0 during the third stage, the potential at the point a is the potential of POWER1(*n*) (i.e., VSS) at the beginning of the fourth stage. The first capacitor C1 and the second capacitor C2 are charged by a current flowing through OLED2 through the DTFT2 in a direction from POWER2(*n*) to POWER1(*n*) since the DTFT2 is turned on by Vref2, and the potential at the point a is increased continuously until the potential at the point a is Vref2−Vthd2, therefore the potential at the point a is: Va=Vref2−Vthd2.

Figure 8:
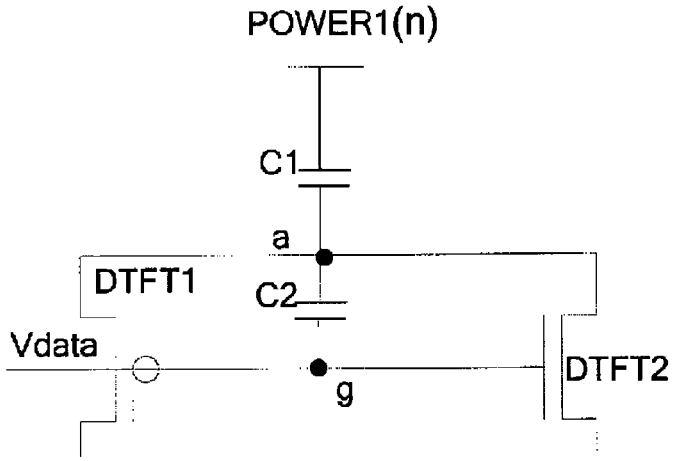
FIG. 8 is an equivalent circuit diagram of the pixel circuit for AC driving operating in a fifth stage provided in the embodiments of the present disclosure.

During a fifth stage t5, the equivalent circuit is as shown in FIG. 8, G(n) is at a high level, and EM(n) transits to a high level, T1 and T3 are turned off, and T2 is turned on. The point a is in a floating state and the voltage at the data line transits from Vref2 to Vdata, therefore the potential at the point a transits as follows due to the coupling effect of C2:

$$Va=Vref2-Vthd2+(Vdata-Vref2)*C2/(C1+C2).$$

Therefore, the voltage across two electrodes of C2 can be represented by:

$$\begin{aligned} Vc2 &= Vg-Va \\ &= Vdata-[Vref2-Vthd2+(Vdata-Vref2)*C2/(C1+C2)] \\ &= (Vdata-Vref2)*C1/(C1+C2)+Vthd2. \end{aligned}$$

In this stage, OLED1 and OLED2 are both in an open-circuit state.

Figure 9:
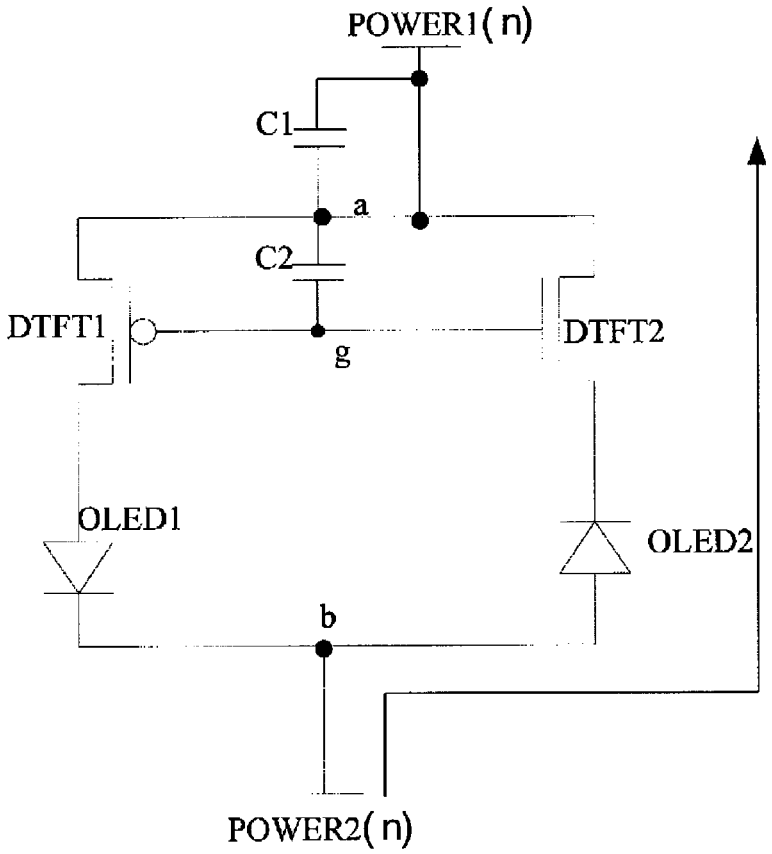
FIG. 9 is an equivalent circuit diagram of the pixel circuit for AC driving operating in a sixth stage provided in the embodiments of the present disclosure.

During a sixth stage t6, the equivalent circuit is as shown in FIG. 9, G(n) transits to a low level, EM(n) transits to a low level, such that T1 and T3 are turned on and T2 is turned off. At this time, OLED2 is forward biased and is in the positive half cycle of the AC driving such that OLED2 enters into the operation state, while OLED1 is reverse biased and is in the negative half cycle of the AC driving such that OLED1 enters into a recovery period and no current flows through OLED1. Therefore, the source of the DTFT1 is in an open-circuit state. In this sixth stage, the first capacitor C1 is short-circuited since T1 is turned on, and the potential at the point a maintains at VSS of the POWER1(*n*).

The gate of the DTFT2 is in a floating state since T2 is turned off, and thus variation of the potential at the point a has no effect on the voltage across the two electrodes of the capacitor C2, and the gate-source voltage of the DTFT2 maintains the voltage across the two electrodes of C2 during its previous stage, that is, $$Vsg=Vc2=(Vdata-Vref2)*C1/(C1+C2)+Vthd2.$$

The driving current flowing through the DTFT2 is the light-emitting current of the OLED2 and can be represented by:

$$\begin{aligned} Ioled2 &= kd2(Vgs-Vthd2)\hat{}2 \\ &= kd2[(Vdata-Vref2)*C1/(C1+C2)+Vthd2-Vthd2]\hat{}2 \\ &= kd2[(Vdata-Vref2)*C1/(C1+C2)]\hat{}2; \end{aligned}$$

Kd2 is a constant relating to the manufacturing process and the size configuration of the driving transistor DTFT2, and Vthd2 is the threshold voltage of the DTFT2. The driving current is only affected by the data voltage Vdata and the second reference voltage Vref2, but is not relevant to the threshold voltage of the driving transistor DTFT2.

During the fourth stage, OLED1 enters into the negative half cycle of the AC driving from the positive half cycle of the AC driving and will stay in the negative half cycle of the AC driving during the time period of a frame. During the negative half cycle of the AC driving, the remaining holes and electrons at the interfaces of the light emitting layer of OLED1 change their moving directions to move toward opposite directions, which is equivalent to consuming the remaining holes and electrons, thus diminishing the built-in electrical field formed inside OLED1 by the remaining carriers in the positive half cycle, further enhancing the carrier injection and recombination in the next positive half cycle, and finally improving the recombination efficiency. Moreover, the reverse bias process in the negative half cycle can "burn out" some microscopic small channels "filaments" turned on locally. Such a filament is actually caused by a kind of "pinhole", and the elimination of the pinholes is very important for extending the usage life of the device. Therefore, in other words, OLED2 is in a recovery period during the time period of this frame.

The operation of the driving circuit during two adjacent frames according to the embodiments of the present disclosure has been described above. It should be explained that the data line should supply different data line voltages for different driving transistors since the driving transistors are different and the expressions of the driving current are also different during the two adjacent frames. Particularly, with reference to the timing sequence state diagram as shown in FIG. 3, during the time period of the $N^{th}$ frame, the data line supplies Vref1 during the first stage and supplies the data signal Vdata during the second stage, and the signal supplied at the data line has no function on the pixel circuits in the row during the third stage since the data signal input unit is closed; during the time period of the $N+1^{th}$ frame, the data line supplies Vref2 during the fourth stage and supplies the data signal Vdata during the fifth stage, and the signal supplied at the data line has no function on the pixel circuits in the row during the sixth stage since the data signal input unit is closed.

Of course, the switching transistors in the pixel circuit can adopt the thin film transistors produced under the process of amorphous silicon, polysilicon, oxide and so one, and the pixel circuit can be easily modified into other NMOS, PMOS or CMOS circuit after simplification, replacement or combination only if the timing sequence relationship of the input signals is adjusted correspondingly. Therefore, any variation or modification falls in the scope of the embodiments of the present disclosure only if it does not depart from the essential nature of the embodiments of the present disclosure.

The above descriptions are only for illustrating the embodiments of the present disclosure, and in no way limit the scope of the present disclosure. It will be obvious that those skilled in the art may make variations or alternatives to the above embodiments without departing from the spirit and scope of the present disclosure as defined by the following claims. Such variations and alternatives are intended to be included within the spirit and scope of the present disclosure. Therefore, the protection scope of the present disclosure should be defined by the protection scope of the accompanying claims.

The present application claims the priority of a Chinese application entitled "pixel circuit for AC driving, driving method and display apparatus" with an application number No. 201310530181.4 and filed on Oct. 31, 2013, the disclosure of which is entirely incorporated herein by reference.

What is claimed is:

1. A pixel circuit for AC driving comprising: a first capacitor, a second capacitor, a first voltage input sub-circuit, a second voltage input sub-circuit, a data signal input sub-circuit, a first light emitting sub-circuit, and a second light emitting sub-circuit; wherein the first light emitting sub-circuit is configured to emit light under the control of a driving control terminal, a first voltage input terminal and a second voltage input terminal;

the second light emitting sub-circuit is configured to emit light under the control of the driving control terminal, the first voltage input terminal and the second voltage input terminal; wherein the first light emitting sub-circuit emits light during a preset first time period and the second light emitting sub-circuit emits light during a preset second time period;

the first voltage input sub-circuit is configured to supply a first input voltage at a first voltage terminal to the first light emitting sub-circuit and the second light emitting sub-circuit under the control of a first scan terminal;

the second voltage input sub-circuit is configured to supply a second input voltage at a second voltage terminal to the first light emitting sub-circuit and the second light emitting sub-circuit under the control of a second scan terminal;

the data signal input sub-circuit is configured to input a data line signal of a data line to the driving control terminal under the control of the first scan terminal;

a first electrode of the first capacitor is connected to the first voltage terminal and a second electrode of the first capacitor is connected to the first voltage input terminal; and a first electrode of the second capacitor is connected to the first voltage input terminal and a second electrode of the second capacitor is connected to the driving control terminal.

2. The pixel circuit of claim 1, wherein the first voltage input sub-circuit comprises a first switching transistor having a gate connected to the first scan terminal, a source connected to the first voltage terminal, and a drain connected to the first voltage input terminal.

3. The pixel circuit of claim 1, wherein the data signal input sub-circuit comprises a second switching transistor having a gate connected to the first scan terminal, a source connected to the data line, and a drain connected to the driving control terminal.

4. The pixel circuit of claim 1, wherein the second voltage input sub-circuit comprises a third switching transistor having a gate connected to the second scan terminal, a source connected to the second voltage terminal, and a drain connected to the second voltage input terminal.

5. The pixel circuit of claim 1, wherein the first light emitting sub-circuit comprises a first driving transistor and a first light emitting diode; the first driving transistor has a gate connected to the driving control terminal and a source connected to the first voltage input terminal; and the first light emitting diode has a first electrode connected to a drain of the first driving transistor and a second electrode connected to the second voltage input terminal; and the second light emitting sub-circuit comprises a second driving transistor and a second light emitting diode; the second driving transistor has a gate connected to the driving control terminal and a source connected to the first voltage input terminal; and the second light emitting diode has a first electrode connected to the second voltage input terminal and a second electrode connected to a drain of the second driving transistor;

the first driving transistor and the second driving transistor are of different types.

6. The pixel circuit of claim 1, wherein the first light emitting sub-circuit emits light during a preset high level period or a preset low level period supplied between the first voltage terminal and the second voltage terminal, and the second light emitting sub-circuit emits light during a preset low level period or a preset high level period supplied between the first voltage terminal and the second voltage terminal.

7. A display apparatus comprising a pixel circuit for AC driving, wherein the pixel circuit comprises: a first capacitor, a second capacitor, a first voltage input sub-circuit, a second voltage input sub-circuit, a data signal input sub-circuit, a first light emitting sub-circuit, and a second light emitting sub-circuit; wherein the first light emitting sub-circuit is configured to emit light under the control of a driving control terminal, a first voltage input terminal and a second voltage input terminal;

the second light emitting sub-circuit is configured to emit light under the control of the driving control terminal, the first voltage input terminal and the second voltage input terminal; wherein the first light emitting sub-circuit emits light during a preset first time period and the second light emitting sub-circuit emits light during a preset second time period;

the first voltage input sub-circuit is configured to supply a first input voltage at a first voltage terminal to the first light emitting sub-circuit and the second light emitting sub-circuit under the control of a first scan terminal;

the second voltage input sub-circuit is configured to supply a second input voltage at a second voltage terminal to the first light emitting sub-circuit and the second light emitting sub-circuit under the control of a second scan terminal;

the data signal input sub-circuit is configured to input a data line signal of a data line to the driving control terminal under the control of the first scan terminal;

a first electrode of the first capacitor is connected to the first voltage terminal and a second electrode of the first capacitor is connected to the first voltage input terminal; and a first electrode of the second capacitor is connected to the first voltage input terminal and a second electrode of the second capacitor is connected to the driving control terminal.

8. The display apparatus of claim 7, wherein the first voltage input sub-circuit comprises a first switching transistor having a gate connected to the first scan terminal, a source connected to the first voltage terminal, and a drain connected to the first voltage input terminal.

9. The display apparatus of claim 7, wherein the data signal input sub-circuit comprises a second switching transistor having a gate connected to the first scan terminal, a source connected to the data line, and a drain connected to the driving control terminal.

10. The display apparatus of claim 7, wherein the second voltage input sub-circuit comprises a third switching transistor having a gate connected to the second scan terminal, a source connected to the second voltage terminal, and a drain connected to the second voltage input terminal.

11. The display apparatus of claim 7, wherein the first light emitting sub-circuit comprises a first driving transistor and a first light emitting diode; the first driving transistor has a gate connected to the driving control terminal and a source connected to the first voltage input terminal; and the first light emitting diode has a first electrode connected to a drain of the first driving transistor and a second electrode connected to the second voltage input terminal; and the second light emitting sub-circuit comprises a second driving transistor and a second light emitting diode; the second driving transistor has a gate connected to the driving control terminal and a source connected to the first voltage input terminal; and the second light emitting diode has a first electrode connected to the second voltage input terminal and a second electrode connected to a drain of the second driving transistor;

the first driving transistor and the second driving transistor are of different types.

12. The display apparatus of claim 7, wherein the first light emitting sub-circuit emits light during a preset high level period or a preset low level period supplied between the first voltage terminal and the second voltage terminal, and the second light emitting sub-circuit emits light during a preset low level period or a preset high level period supplied between the first voltage terminal and the second voltage terminal.

13. A driving method of a pixel circuit for AC driving, wherein the pixel circuit comprises: a first capacitor, a second capacitor, a first voltage input sub-circuit, a second voltage input sub-circuit, a data signal input sub-circuit, a first light emitting, and a second light emitting; the driving method comprises:

during a first stage, controlling the first voltage input sub-circuit to close and the data signal input sub-circuit to operate by aid of the first scan terminal such that a first reference voltage is input to the driving control terminal from the data line, and controlling the second voltage input sub-circuit to operate by aid of the second scan terminal such that the second voltage input terminal and the second voltage terminal are connected to each other to supply a second input voltage at a second voltage terminal to the first light emitting sub-circuit and the second light emitting sub-circuit, the first capacitor and the second capacitor are charged to reset a voltage at the first voltage input terminal, wherein a first electrode of the first capacitor is connected to the first voltage terminal and a second electrode of the first capacitor is connected to the first voltage input terminal; and a first electrode of the second capacitor is connected to the first voltage input terminal and a second electrode of the second capacitor is connected to the driving control terminal;

during a second stage, controlling the first voltage input sub-circuit to close and the data signal input sub-circuit to operate by aid of the first scan terminal such that a data voltage is input to the driving control terminal from the data line, and controlling the second voltage input sub-circuit to close by aid of the second scan terminal such that the voltage at the first voltage input terminal transits due to coupling effect of the second capacitor;

during a third stage, controlling the first voltage input sub-circuit to operate to supply a first input voltage at a first voltage terminal to the first light emitting sub-circuit and the second light emitting sub-circuit and the data signal input sub-circuit to close by aid of the first scan terminal, and controlling the second voltage input sub-circuit to operate to supply a second input voltage at the second voltage terminal to the first light emitting sub-circuit and the second light emitting sub-circuit by aid of the second scan terminal such that the first light emitting sub-circuit is driven to emit light by aid of the driving control terminal, the first voltage input terminal and the second voltage input terminal;

during a fourth stage, controlling the first voltage input sub-circuit to close and the data signal input sub-circuit to operate by aid of the first scan terminal such that a second reference voltage is input to the driving control terminal from the data line, and controlling the second voltage input sub-circuit to operate to supply a second input voltage at the second voltage terminal to the first light emitting sub-circuit and the second light emitting sub-circuit by aid of the second scan terminal such that the second voltage input terminal and the second voltage terminal are connected to each other, the first capacitor and the second capacitor are charged to reset the voltage at the first voltage input terminal;

during a fifth stage, controlling the first voltage input sub-circuit to close and the data signal input sub-circuit to operate by aid of the first scan terminal such that a data voltage is input to the driving control terminal from the data line, and controlling the second voltage input sub-circuit to close by aid of the second scan terminal such that the voltage at the first voltage input terminal transits due to coupling effect of the second capacitor; and during a sixth stage, controlling the first voltage input sub-circuit to operate to supply a first input voltage at the first voltage terminal to the first light emitting sub-circuit and the second light emitting sub-circuit and the data signal input sub-circuit to close by aid of the first scan terminal, and controlling the second voltage input sub-circuit to operate to supply a second input voltage at the second voltage terminal to the first light emitting sub-circuit and the second light emitting sub-circuit by aid of the second scan terminal such that the second light emitting sub-circuit is driven to emit light by aid of the driving control terminal, the first voltage input terminal and the second voltage input terminal.

14. The driving method of claim 13, wherein the first voltage input sub-circuit comprises a first switching transistor having a gate connected to the first scan terminal, a source connected to the first voltage terminal, and a drain connected to the first voltage input terminal;

the data signal input sub-circuit comprises a second switching transistor having a gate connected to the first scan terminal, a source connected to the data line, and a drain connected to the driving control terminal;

the second voltage input sub-circuit comprises a third switching transistor having a gate connected to the second scan terminal, a source connected to the second voltage terminal, and a drain connected to the second voltage input terminal, the first light emitting sub-circuit comprises a first driving transistor and a first light emitting diode; the first driving transistor has a gate connected to the driving control terminal and a source connected to the first voltage input terminal; and the first light emitting diode has a first electrode connected to a drain of the first driving transistor and a second electrode connected to the second voltage input terminal; and the second light emitting sub-circuit comprises a second driving transistor and a second light emitting diode; the second driving transistor has a gate connected to the driving control terminal and a source connected to the first voltage input terminal; and the second light emitting diode has a first electrode connected to the second voltage input terminal and a second electrode connected to a drain of the second driving transistor; the first driving transistor and the second driving transistor are of different types, in the driving method, during the first stage, the first switching transistor and the second driving transistor are turned off, and the second switching transistor, the third switching transistor and the first driving transistor are turned on;

during the second stage, the first switching transistor and the third switching transistor are turned off, the second switching transistor is turned on, and the first driving transistor and the second driving transistor are in an open-circuit state;

during the third stage, the first switching transistor, the third switching transistor and the first driving transistor are turned on, and the second switching transistor and the second driving transistor are turned off;

during the fourth stage, the first switching transistor and the first driving transistor are turned off, and the second switching transistor, the third switching transistor and the second driving transistor are turned on;

during the fifth stage, the first switching transistor and the third switching transistor are turned off, the second switching transistor is turned on, and the first driving transistor and the second driving transistor are in an open-circuit state; and during the sixth stage, the first switching transistor, the third switching transistor and the second driving transistor are turned on, and the second switching transistor and the first driving transistor are turned off.

15. The driving method of claim 14, wherein during the first stage to the third stage, the first input voltage at the first voltage terminal is at a first level, and the second input voltage at the second voltage terminal is at a second level; and during the fourth stage to the sixth stage, the first input voltage at the first voltage terminal is at the second level, and the second input voltage at the second voltage terminal is at the first level.

16. The driving method of claim 15, wherein during the first stage, the first capacitor and the second capacitor are charged in a first direction so as to reset a voltage at the first voltage input terminal to a first value; and during the fourth stage, the first capacitor and the second capacitor are charged in a direction opposite to the first direction so as to reset a voltage at the first voltage input terminal to a second value.

* * * * *